US010242622B2

(12) United States Patent
Tseng et al.

(10) Patent No.: US 10,242,622 B2
(45) Date of Patent: Mar. 26, 2019

(54) PIXEL COMPENSATION CIRCUIT, ORGANIC LIGHT-EMITTING DISPLAY PANEL AND ORGANIC LIGHT-EMITTING DISPLAY DEVICE THEREOF

(71) Applicant: Shanghai Tianma Micro-Electronics Co., Ltd., Shanghai (CN)

(72) Inventors: Chang-ho Tseng, Xiamen (CN); Chuanli Leng, Shanghai (CN); Yuan Li, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 0 days.

(21) Appl. No.: 15/865,541

(22) Filed: Jan. 9, 2018

(65) Prior Publication Data

US 2018/0151115 A1 May 31, 2018

(30) Foreign Application Priority Data

Sep. 29, 2017 (CN) ..... 2017 1 0912349

(51) Int. Cl.
*G09G 3/325* (2016.01)
*G09G 3/3266* (2016.01)
*G09G 3/3275* (2016.01)

(52) U.S. Cl.
CPC ..... *G09G 3/325* (2013.01); *G09G 3/3266* (2013.01); *G09G 3/3275* (2013.01); *G09G 2300/0809* (2013.01); *G09G 2310/0243* (2013.01); *G09G 2310/0264* (2013.01)

(58) Field of Classification Search
CPC ..... G09G 3/3208; G09G 3/3233; G09G 2320/043; G09G 2320/045
See application file for complete search history.

(56) References Cited

U.S. PATENT DOCUMENTS 8,237,637 B2 8/2012 Chung
2014/0210867 A1* 7/2014 Kwon ..... G09G 3/3258 345/690
2014/0353616 A1* 12/2014 Park ..... G09G 3/3208 257/40
2017/0365213 A1* 12/2017 Rieutort-Louis .... G09G 3/3233
(Continued)

FOREIGN PATENT DOCUMENTS

CN 106297659 A 1/2017

*Primary Examiner* — Yuzhen Shen
(74) *Attorney, Agent, or Firm* — Anova Law Group, PLLC

(57) ABSTRACT

A pixel compensation circuit, an organic light-emitting display panel and an organic light-emitting display device are provided. The pixel compensation circuit includes a first switch transistor, a second switch transistor, a third switch transistor, a fourth switch transistor, a fifth switch transistor, a sixth switch transistor, a light-emitting element, a seventh switch transistor, a storage capacitor, and a drive transistor. The first switch transistor, the fourth switch transistor, and the fifth switch transistor provide a signal on a reference voltage signal terminal to a first node and provide a threshold voltage to a gate of the drive transistor. The second switch transistor and the third switch transistor couple a signal on a first power supply terminal in real time to the gate of the drive transistor. A driving current generated by the drive transistor is protected from adverse effects caused by IR Drop on the first power supply terminal.

20 Claims, 10 Drawing Sheets

(56) References Cited

U.S. PATENT DOCUMENTS

| | | | | |
|---|---|---|---|---|
| 2018/0005569 | A1* | 1/2018 | Li | G09G 3/3233 |
| 2018/0061324 | A1* | 3/2018 | Kim | G09G 3/3275 |
| 2018/0122298 | A1* | 5/2018 | Lee | G09G 3/3233 |
| 2018/0254433 | A1* | 9/2018 | Choi | H01L 51/5253 |

* cited by examiner

PIXEL COMPENSATION CIRCUIT, ORGANIC LIGHT-EMITTING DISPLAY PANEL AND ORGANIC LIGHT-EMITTING DISPLAY DEVICE THEREOF

CROSS-REFERENCES TO RELATED APPLICATIONS

This application claims the priority of Chinese patent application No. 201710912349.6, filed on Sep. 29, 2017, the entirety of which is incorporated herein by reference.

FIELD OF THE DISCLOSURE

The present disclosure generally relates to the field of display technology and, more particularly, relates to a pixel compensation circuit, an organic light-emitting display panel, and an organic light-emitting display device thereof.

BACKGROUND

An organic light-emitting diode (OLED) is one of the hot spots in the research field of current panel display. Compared with a liquid crystal display (LCD), the OLED display has advantages of low energy consumption, low production cost, self-luminescence, wide viewing angle, and fast response speed, etc. In contrast to the LCD that uses a stable voltage to control brightness, the OLED is driven by a current and requires a steady current to control its light emitting. Generally, in the OLED display, a data signal is inputted to a gate of a drive transistor in a pixel circuit through a data line, and a power supply voltage VDD is inputted to a source of the drive transistor through a power signal line, such that the drive transistor may generate a driving current under the effect of a gate-source voltage to drive the connected OLED to emit light. Due to reasons such as processes and aging, there may be a drift in a threshold voltage $V_{th}$ of the drive transistor in the pixel circuit, which may cause that the current flowing through each OLED varies under the influence of the drift in the threshold voltage $V_{th}$, and may further cause an unevenness in displaying brightness. Thus, a visual effect of an overall image may be affected.

Since the current flowing through each OLED is related to the power supply voltage VDD connected to the source of the drive transistor, the power supply voltage VDD received by the drive transistor in the pixel circuit needs to be constant in an ideal state. However, as the OLED display in color display, since different color pixel units emit light differently, the currents flowing into OLEDs in different color pixel units are different, such that the current in the power signal line also fluctuates, resulting in a fluctuation of the IR drop on the power signal line. Thus, the voltage value of a high-potential signal VDD inputted to the pixel circuit may change, resulting in the current difference in different regions and further causing the occurrence of unevenness in displaying brightness of the OLEDs in different regions. The disclosed device structures and methods are directed to solve one or more problems set forth above and other problems.

BRIEF SUMMARY OF THE DISCLOSURE

One aspect of the present disclosure includes a pixel compensation circuit. The pixel compensation circuit includes a first switch transistor for providing a signal on a reference voltage signal terminal to a first electrode of a drive transistor under the control of a first scan signal terminal, and a second switch transistor for providing a signal on a first power supply terminal to the first electrode of the drive transistor under the control of a first light-emitting control signal terminal. The pixel compensation circuit also includes a third switch transistor for conducting the first electrode of the drive transistor and a first node under the control of the first light-emitting control signal terminal, and a fourth switch transistor for providing a signal on a data signal terminal to the first node under the control of the first scan signal terminal. In addition, the pixel compensation circuit includes a fifth switch transistor for conducting a gate of the drive transistor and a second electrode of the drive transistor under the control of the first scan signal terminal, and a sixth switch transistor for providing a signal on an initialization signal terminal to the gate of the drive transistor under the control of a second scan signal terminal. Moreover, the pixel compensation circuit includes a light-emitting element having a first terminal and a second terminal, the second terminal being connected to a second power supply terminal, and a seventh switch transistor for providing a driving current generated by the drive transistor to the light-emitting element under the control of a second light-emitting control signal terminal to drive the light-emitting element to emit light. Further, the pixel compensation circuit includes a storage capacitor for coupling a voltage on the first node to the gate of the drive transistor when floated, and the drive transistor for generating the driving current under the control of a voltage difference between the gate and the first electrode.

Another aspect of the present disclosure includes an organic light-emitting display panel including a pixel compensation circuit. The pixel compensation circuit includes a first switch transistor for providing a signal on a reference voltage signal terminal to a first electrode of a drive transistor under the control of a first scan signal terminal, and a second switch transistor for providing a signal on a first power supply terminal to the first electrode of the drive transistor under the control of a first light-emitting control signal terminal. The pixel compensation circuit also includes a third switch transistor for conducting the first electrode of the drive transistor and a first node under the control of the first light-emitting control signal terminal, and a fourth switch transistor for providing a signal on a data signal terminal to the first node under the control of the first scan signal terminal. In addition, the pixel compensation circuit includes a fifth switch transistor for conducting a gate of the drive transistor and a second electrode of the drive transistor under the control of the first scan signal terminal, and a sixth switch transistor for providing a signal on an initialization signal terminal to the gate of the drive transistor under the control of a second scan signal terminal. Moreover, the pixel compensation circuit includes a light-emitting element having a first terminal and a second terminal, the second terminal being connected to a second power supply terminal, and a seventh switch transistor for providing a driving current generated by the drive transistor to the light-emitting element under the control of a second light-emitting control signal terminal to drive the light-emitting element to emit light. Further, the pixel compensation circuit includes a storage capacitor for coupling a voltage on the first node to the gate of the drive transistor when floated, and the drive transistor for generating the driving current under the control of a voltage difference between the gate and the first electrode.

Another aspect of the present disclosure includes an organic light-emitting display device. The organic light-emitting display device includes an organic light-emitting display panel including a pixel compensation circuit. The pixel compensation circuit includes a first switch transistor for providing a signal on a reference voltage signal terminal to a first electrode of a drive transistor under the control of a first scan signal terminal, and a second switch transistor for providing a signal on a first power supply terminal to the first electrode of the drive transistor under the control of a first light-emitting control signal terminal. The pixel compensation circuit also includes a third switch transistor for conducting the first electrode of the drive transistor and a first node under the control of the first light-emitting control signal terminal, and a fourth switch transistor for providing a signal on a data signal terminal to the first node under the control of the first scan signal terminal. In addition, the pixel compensation circuit includes a fifth switch transistor for conducting a gate of the drive transistor and a second electrode of the drive transistor under the control of the first scan signal terminal, and a sixth switch transistor for providing a signal on an initialization signal terminal to the gate of the drive transistor under the control of a second scan signal terminal. Moreover, the pixel compensation circuit includes a light-emitting element having a first terminal and a second terminal, the second terminal being connected to a second power supply terminal, and a seventh switch transistor for providing a driving current generated by the drive transistor to the light-emitting element under the control of a second light-emitting control signal terminal to drive the light-emitting element to emit light. Further, the pixel compensation circuit includes a storage capacitor for coupling a voltage on the first node to the gate of the drive transistor when floated, and the drive transistor for generating the driving current under the control of a voltage difference between the gate and the first electrode.

Other aspects of the present disclosure can be understood by those skilled in the art in light of the description, the claims, and the drawings of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or the alike parts. The described embodiments are some but not all of the embodiments of the present disclosure. Based on the disclosed embodiments, persons of ordinary skill in the art may derive other embodiments consistent with the present disclosure, all of which are within the scope of the present disclosure.

Figure 1:
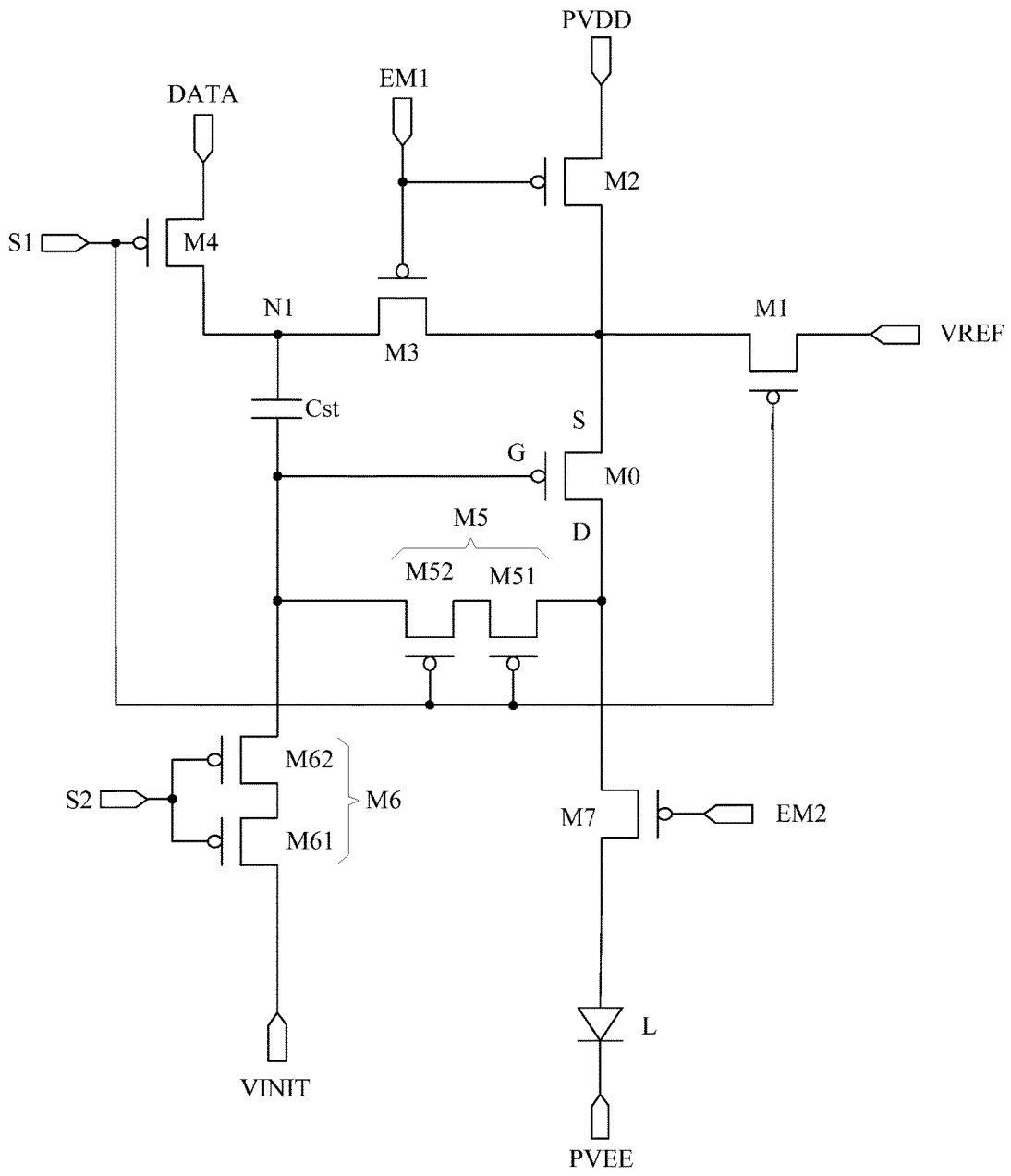
FIG. 1 illustrates a schematic diagram of a pixel compensation circuit consistent with various disclosed embodiments of the present disclosure.

The present disclosure provides a pixel compensation circuit. FIG. 1 illustrates a schematic diagram of a pixel compensation circuit. Referring to FIG. 1, the pixel compensation circuit may include a first switch transistor M1, a second switch transistor M2, a third switch transistor M3, a fourth switch transistor M4, a fifth switch transistor M5, a sixth switch transistor M6, a seventh switch transistor M7, a light-emitting device (also referred to as light-emitting element) L, a storage capacitor Cst, and a drive transistor M0. Some components may be omitted and other components may be added.

The first switch transistor M1 may provide a signal VREF on a reference voltage signal terminal to a first electrode S of the drive transistor M0 under the control of a first scan signal terminal S1. The second switch transistor M2 may provide a signal PVDD on a first power supply terminal to the first electrode S of the drive transistor M0 under the control of a first light-emitting control signal terminal EM1. The third switch transistor M3 may conduct the first electrode S of the drive transistor M0 and a first node N1 under the control of the first light-emitting control signal terminal EM1. The fourth switch transistor M4 may provide a signal DATA on a data signal terminal to the first node N1 under the control of the first scan signal terminal S1. The fifth switch transistor M5 may conduct a gate G of the drive transistor M0 and a second electrode D of the drive transistor M0 under the control of the first scan signal terminal S1. The sixth switch transistor M6 may provide a signal VINIT on an initialization signal terminal to the gate G of the drive transistor M0 under the control of a second scan signal terminal S2. The seventh switch transistor M7 may provide a driving current generated by the drive transistor M0 to the light-emitting device L under the control of a second light-emitting control signal terminal EM2 to drive the light-emitting device L to emit light. A second terminal of the light-emitting device L may be connected to a second power supply terminal PVEE. The storage capacitor Cst may couple the voltage on the first node N1 to the gate G of the drive transistor M0 when the gate G of the drive transistor M0 is floated. The drive transistor M0 may generate the driving current under the control of the voltage difference between the gate G and the first electrode S thereof.

Accordingly, the disclosed pixel compensation circuit may include the first switch transistor, the second switch transistor, the third switch transistor, the fourth switch transistor, the fifth switch transistor, the sixth switch transistor, the seventh switch transistor, the drive transistor, the storage capacitor and the light-emitting device. The signal on the data signal terminal may be inputted to the first node and a threshold voltage may be inputted to the gate of the drive transistor through the first switch transistor, the fourth switch transistor and the fifth switch transistor and, thus, the function for compensating the threshold voltage of the drive transistor may be realized. The signal on the first power supply terminal may be coupled in real time to the gate of the drive transistor through the second switch transistor and the third switch transistor when emitting light. Therefore, the driving current generated by the drive transistor may be protected from adverse effects caused by the IR Drop on the first power supply terminal, the unevenness in displaying brightness of the display panel may be improved and the screen display effect may be further improved.

In one embodiment, in the pixel compensation circuit consistent with disclosed embodiments, referring to FIG. 1, the drive transistor M0 may be a P-type transistor. The first electrode S of the drive transistor M0 may be the source thereof, and the second electrode D of the drive transistor M0 may be the drain thereof. When the drive transistor M0 is in a saturated state, the current may flow from the source of the drive transistor M0 to the drain thereof.

In one embodiment, in the pixel compensation circuit consistent with disclosed embodiments, the first terminal of the light-emitting device may be a positive electrode thereof and the second terminal of the light-emitting device may be a negative electrode thereof. The light-emitting device may be generally an electroluminescent diode, such as an organic light-emitting diode, which emits light under the effect of the driving current when the drive transistor is in a saturated state. In addition, the general light-emitting device may have a light-emitting threshold voltage and may emit light when the voltage across the light-emitting device is greater than or equal to the light-emitting threshold voltage.

In one embodiment, in the pixel compensation circuit consistent with disclosed embodiments, the voltage on the first power supply terminal $V_{dd}$ may be generally a positive value, and the voltage on the second power supply terminal $V_{ee}$ may be generally ground or a negative value. The relationship between the voltage $V_{ref}$ on the reference voltage signal terminal and the voltage $V_{init}$ on the initialization signal terminal may include that the voltage difference between the voltage $V_{ref}$ on the reference voltage signal terminal and the voltage $V_{init}$ on the initialization signal terminal may be greater than the threshold voltage $V_{th}$ of the drive transistor; that is, $V_{ref}-V_{init}>|V_{th}|$. In practical applications, the specific values of the above-described voltages may need to be designed and determined according to the actual application environments, and are not limited herein.

In one embodiment, in the pixel compensation circuit consistent with disclosed embodiments, referring to FIG. 1, the gate of the first switch transistor M1 may be connected to the first scan signal terminal S1. The first electrode of the first switch transistor M1 may be connected to the reference voltage signal terminal VREF. The second electrode of the first switch transistor M1 may be connected to the first electrode S of the drive transistor M0. In one embodiment, the first switch transistor M1 may be a P-type transistor. In another embodiment, the first switch transistor may be an N-type transistor.

In one embodiment, in the pixel compensation circuit consistent with disclosed embodiments, referring to FIG. 1, the gate of the second switch transistor M2 may be connected to the first light-emitting control signal terminal EM1. The first electrode of the second switch transistor M2 may be connected to the first power supply terminal PVDD. The second electrode of the second switch transistor M2 may be connected to the first electrode S of the drive transistor M0. In one embodiment, the second switch transistor M2 may be a P-type transistor. In another embodiment, the second switch transistor may be an N-type transistor.

In one embodiment, in the pixel compensation circuit consistent with disclosed embodiments, referring to FIG. 1, the gate of the third switch transistor M3 may be connected to the first light-emitting control signal terminal EM1. The first electrode of the third switch transistor M3 may be connected to the first electrode S of the drive transistor M0. The second electrode of the third switch transistor M3 may be connected to the first node N1. In one embodiment, the third switch transistor M3 may be a P-type transistor. In another embodiment, the third switch transistor may be an N-type transistor.

In one embodiment, in the pixel compensation circuit consistent with disclosed embodiments, referring to FIG. 1, the gate of the fourth switch transistor M4 may be connected to the first scan signal terminal S1. The first electrode of the fourth switch transistor M4 may be connected to the data signal terminal DATA. The second electrode of the fourth switch transistor M4 may be connected to the first node N1. In one embodiment, the fourth switch transistor M4 may be a P-type transistor. In another embodiment, the fourth switch transistor may be an N-type transistor.

In one embodiment, in the pixel compensation circuit consistent with disclosed embodiments, referring to FIG. 1, the gate of the fifth switch transistor M5 may be connected to the first scan signal terminal S1. The first electrode of the fifth switch transistor M5 may be connected to the second electrode D of the drive transistor M0. The second electrode of the fifth switch transistor M5 may be connected to the gate G of the drive transistor M0. In one embodiment, the fifth switch transistor M5 may be a P-type transistor. In another embodiment, the fifth switch transistor may be an N-type transistor.

In one embodiment, in the pixel compensation circuit consistent with disclosed embodiments, referring to FIG. 1, the fifth switch transistor M5 may be a double gate structure. The double gate structure may include a first sub-transistor M51 and a second sub-transistor M52 connected in series. Both the gate of the first sub-transistor M51 and the gate of the second sub-transistor M52 may be connected to the first scan signal terminal S1. The first electrode of the first sub-transistor M51 may be connected to the second electrode D of the drive transistor M0. The second electrode of the first sub-transistor M51 may be connected to the first electrode of the second sub-transistor M52. The second electrode of the second sub-transistor M52 may be connected to the gate G of the drive transistor M0. In this case, the off leakage current of the fifth switch transistor M5 may be reduced. Therefore, when the light-emitting device emits light, the interference of the leakage current of the fifth switch transistor M5 with the drive transistor M0 may be reduced, and the driving current generated by the drive transistor M0 and for driving the light-emitting device to emit light may be protected from being affected.

In one embodiment, a width of a channel region in an active layer of the fifth switch transistor M5 may be in a range of approximately 2.5 μm-3.5 μm, and a length of the channel region in the active layer of the fifth switch transistor M5 may be in a range of approximately 6 μm-8 μm. In one embodiment, the width of the channel region in the active layer of the fifth switch transistor M5 may be 2.5 μm, and the length thereof may be 6 μm or 8 μm. In another embodiment, the width of the channel region in the active layer of the fifth switch transistor M5 may be 3.5 μm, and the length thereof may be 6 μm or 8 μm. In practical applications, the width and the length of the channel region in the active layer of the fifth switch transistor may need to be designed and determined according to the actual application environments, and are not limited herein. In certain embodiments, the fifth switch transistor may be a single-gate structure, or other structures.

In one embodiment, in the pixel compensation circuit consistent with disclosed embodiments, referring to FIG. 1, the gate of the sixth switch transistor M6 may be connected to the second scan signal terminal S2. The first electrode of the sixth switch transistor M6 may be connected to the initialization signal terminal VINIT. The second electrode of the sixth switch transistor M6 may be connected to the gate G of the drive transistor M0. In one embodiment, the sixth switch transistor M6 may be a P-type transistor. In another embodiment, the sixth switch transistor may be an N-type transistor.

In one embodiment, in the pixel compensation circuit consistent with disclosed embodiments, referring to FIG. 1, the sixth switch transistor M6 may be a double gate structure. The double gate structure may include a third sub-transistor M61 and a fourth sub-transistor M62 connected in series. Both the gate of the third sub transistor M61 and the gate of the fourth sub transistor M62 may be connected to the second scan signal terminal S2. The first electrode of the third sub transistor M61 may be connected to the initialization signal terminal VINIT. The second electrode of the third sub-transistor M61 may be connected to the first electrode of the fourth sub-transistor M62. The second electrode of the fourth sub-transistor M62 may be connected to the gate G of the drive transistor M0. In this case, the off leakage current of the sixth switch transistor M6 may be reduced. Therefore, when the light-emitting device emits light, the interference of the leakage current of the sixth switch transistor M6 with the drive transistor M0 may be reduced, and the driving current generated by the drive transistor M0 and for driving the light-emitting device to emit light may be protected from being affected.

In one embodiment, a width of a channel region in an active layer of the sixth switch transistor M6 may be in a range of approximately 2.5 μm-3.5 μm, and a length of the channel region in the active layer of the sixth switch transistor M6 may be in a range of approximately 6 μm-8 μm. In one embodiment, the width of the channel region in the active layer of the sixth switch transistor M6 may be 2.5 μm, and the length thereof may be 6 μm or 8 μm. In another embodiment, the width of the channel region in the active layer of the sixth switch transistor M6 may be 3.5 μm, and the length thereof may be 6 μm or 8 μm. In practical applications, the width and the length of the channel region in the active layer of the sixth switch transistor may need to be designed and determined according to the actual application environments, and are not limited herein. In certain embodiments, the sixth switch transistor may be a single-gate structure, or other structures.

In one embodiment, in the pixel compensation circuit consistent with disclosed embodiments, referring to FIG. 1, the gate of the seventh switch transistor M7 may be connected to the second light-emitting control signal terminal EM2. The first electrode of the seventh switch transistor M7 may be connected to the second electrode D of the drive transistor M0. The second electrode of the seventh switch transistor M7 may be connected to the first terminal of the light-emitting device L. In one embodiment, the seventh switch transistor M7 may be a P-type transistor. In another embodiment, the seventh switch transistor may be an N-type transistor.

In one embodiment, in the pixel compensation circuit consistent with disclosed embodiments, in addition to the fifth switch transistor and the sixth switch transistor, the other transistors may be a double gate structure in view of reducing the leakage current. In the pixel compensation circuit, when the transistor is a double gate structure, a width of a channel region in an active layer of the transistor may be in a range of approximately 2.5 μm-3.5 μm, and a length of the channel region in the active layer of the transistor may be in a range of approximately 6 μm-8 μm. In one embodiment, the width of the channel region in the active layer of the transistor may be 2.5 μm, and the length thereof may be 6 μm or 8 μm. In another embodiment, the width of the channel region in the active layer of the transistor may be 3.5 μm, and the length thereof may be 6 μm or 8 μm. In practical applications, the width and the length of the channel region in the active layer of the transistor may need to be designed and determined according to the actual application environments, and are not limited herein.

In certain embodiments, the above remaining transistors other than the fifth switch transistor and the sixth switch transistor may be a single-gate structure, or other structures. When the transistor is a single-gate structure, a width of a channel region in an active layer of the transistor may be in a range of approximately 2.5 μm-3.5 μm, and a length of the channel region in the active layer of the transistor may be in a range of approximately 3 μm-4 μm. In practical applications, the width and the length of the channel region in the active layer of the transistor may need to be designed and determined according to the actual application environments, and are not limited herein. In one embodiment, in the pixel compensation circuit consistent with disclosed embodiments, referring to FIG. 1, the entire transistors may be P-type transistors.

In one embodiment, in the pixel compensation circuit consistent with disclosed embodiments, referring to FIG. 1, the first terminal of the storage capacitor Cst may be connected to the first node N1, and the second terminal of the storage capacitor Cst may be connected to the gate G of the drive transistor M0. The storage capacitor Cst may be charged or discharged under the action of the signal on the first node N1 and the signal on the gate G of the drive transistor M0. When the gate G of the drive transistor M0 is floated, the signal on the first node N1 may be coupled to the gate G of the drive transistor M0 through the coupling effect of the storage capacitor Cst.

The pixel compensation circuit illustrated in FIG. 1 in combination with the circuit timing sequence diagram are used as an example in the following to describe the operation process of the pixel compensation circuit consistent with disclosed embodiments. Among them, '1' indicates a high-potential signal and '0' indicates a low-potential signal. '1' and '0' are logic potentials to better explain the specific operation process in various embodiments of the present disclosure, rather than the specific voltage values.

Figure 7:
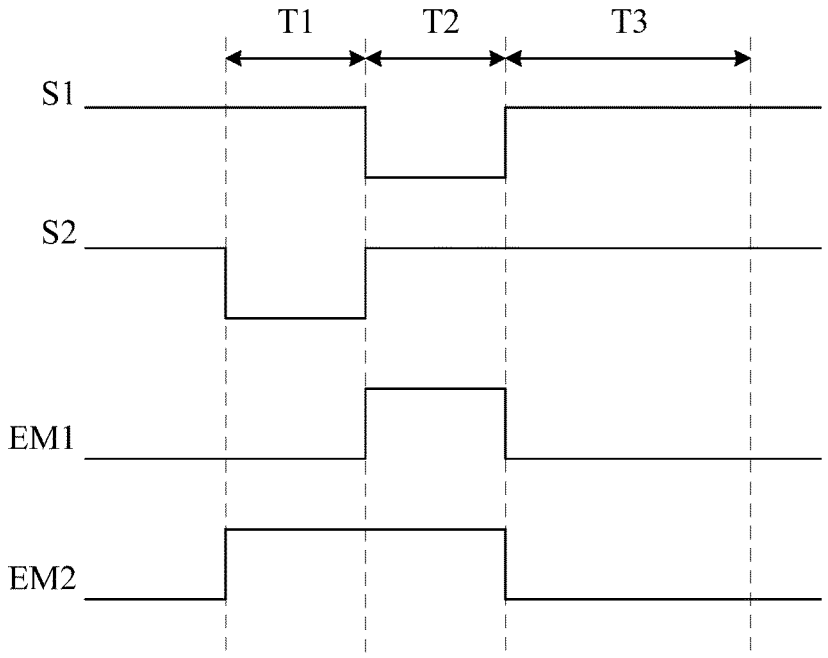
FIG. 7 illustrates a circuit timing sequence diagram consistent with various disclosed embodiments of the present disclosure.

FIG. 7 illustrates a circuit timing sequence diagram corresponding to the pixel compensation circuit illustrated in FIG. 1. In one embodiment, an initialization phase T1, a threshold compensation phase T2 and a light-emitting phase T3 in the circuit timing sequence diagram illustrated in FIG. 7 are selected.

In the initialization phase T1, S1=1, S2=0, EM1=0, and EM2=1. Since S2=0, the sixth switch transistor M6 may be turned on and the signal on the initialization signal terminal VINIT may be provided to the gate G of the drive transistor M0 to initialize the gate G of the drive transistor M0. Since EM1=0, both the second switch transistor M2 and the third switch transistor M3 may be turned on. The turned-on second switch transistor M2 may provide the signal on the first power supply terminal PVDD to the first electrode S of the drive transistor M0. The first electrode S of the drive transistor M0 may be initialized, such that the voltage on the first electrode of the drive transistor may be tripped by a uniform voltage in the threshold compensation phase T2 and an afterimage phenomenon may be improved. The turned-on second switch transistor M2 and the third switch transistor M3 may provide the signal on the first power supply terminal PVDD to the first node N1 to initialize the first node N1, such that the voltage on the first node N1 may be $V_{dd}$. Since S1=1, the first switch transistor M1, the fourth switch transistor M4 and the fifth switch transistor M5 may be turned off. Since EM2=1, the seventh switch transistor M7 may be turned off.

In the threshold compensation phase T2, S1=0, S2=1, EM1=1, and EM2=1. Since S1=0, the first switch transistor M1, the fourth switch transistor M4 and the fifth switch transistor M5 may be turned on. The turned-on fourth switch transistor M4 may provide the signal on the data signal terminal DATA to the first node N1, such that the voltage on the first node N1 may be the voltage $V_{data}$ of the signal on the data signal terminal DATA. The turned-on fifth switch transistor M5 may conduct the gate G of the drive transistor M0 and the second electrode D thereof, such that the drive transistor M0 may be in a diode connection state. The turned-on first switch transistor M1 may provide the signal on the reference voltage signal terminal VREF to the first electrode S of the drive transistor M0 and charge the gate G of the drive transistor M0 through the drive transistor M0 in the diode-connection state until the voltage on the gate G of the drive transistor M0 becomes: $V_{ref}-|V_{th}|$, such that the gate G of the drive transistor M0 may capture the threshold voltage $V_{th}$. Since S2=1, the sixth switch transistor M6 may be turned off. Since EM1=1, both the second switch transistor M2 and the third switch transistor M3 may be turned off. Since EM2=1, the seventh switch transistor M7 may be turned off.

In the light-emitting phase T3, S1=1, S2=1, EM1=0, and EM2=0. Since EM1=0, both the second switch transistor M2 and the third switch transistor M3 may be turned on. The turned-on second switch transistor M2 may provide the signal on the first power supply terminal PVDD to the first electrode S of the drive transistor M0, such that the voltage on the first electrode S may be $V_{dd}$. The turned-on second switch transistor M2 and the third switch transistor M3 may provide the signal on the first power supply terminal PVDD to the first node N1, such that the voltage on the first node N1 may be changed to $V_{dd}$.

Since the gate G of the drive transistor M0 is floated, to keep the voltage difference across the storage capacitor Cst stable, the voltage on the gate G of the drive transistor M0 may be jumped to: $V_{dd}-V_{data}+V_{ref}-|V_{th}|$, due to the coupling effect of the storage capacitor Cst. Therefore, the driving current $I_L$ generated by the drive transistor M0 and for driving the light-emitting device L to emit light may satisfy the formula: $I_L=K(V_{sg}-|V_{th}|)^2=K(V_{dd}-V_{dd}+V_{data}-V_{ref}+|V_{th}|-|V_{th}|)^2=K(V_{data}-V_{ref})^2$; where $V_{sg}$ is a source-gate voltage of the drive transistor M0, and K is a structural parameter which may be relatively stable in a same structure and regarded as a constant.

Since EM2=0, the seventh transistor M7 may be turned on, such that the driving current $I_L$ generated by the drive transistor M0 may drive the light-emitting device L to emit light. Therefore, the driving current may be related to the voltage $V_{ref}$ on the reference voltage signal terminal VREF and the voltage $V_{data}$ on the data signal terminal DATA, and may not be related to the threshold voltage $V_{th}$ of the drive transistor M0 and the voltage $V_{dd}$ on the first power supply terminal VDD. Thus, the influence of the drift in the threshold voltage $V_{th}$ of the drive transistor M0 and IR Drop on the driving current may be resolved, and the driving current of the light-emitting device L may be stabilized, thereby ensuring the normal operation of the light-emitting device L.

In the above embodiment, in the light-emitting phase, since the first terminal of the storage capacitor is directly conducted with the first power supply terminal, the voltage of the signal on the first power supply terminal may be coupled in real time to the first node. Therefore, when the voltage on the first power supply terminal changes due to the IR Drop, the influence of the voltage change of the first power supply terminal on the driving current $I_L$ may be avoided in real time, such that the unevenness in displaying brightness of the display panel may be improved and the screen display effect may be improved.

Figure 2A:
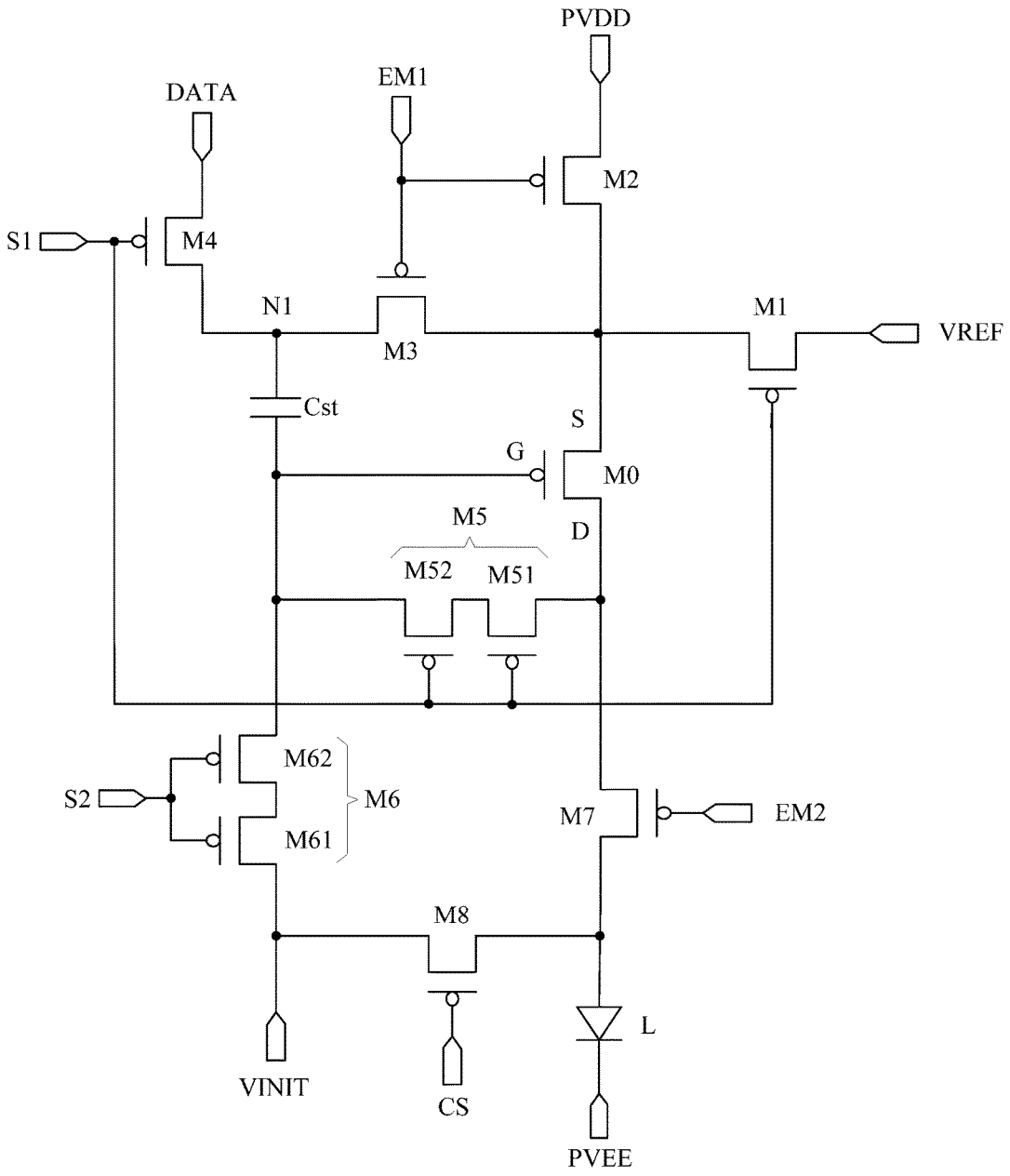
FIG. 2A illustrates another schematic diagram of a pixel compensation circuit consistent with various disclosed embodiments of the present disclosure.
Figure 2B:
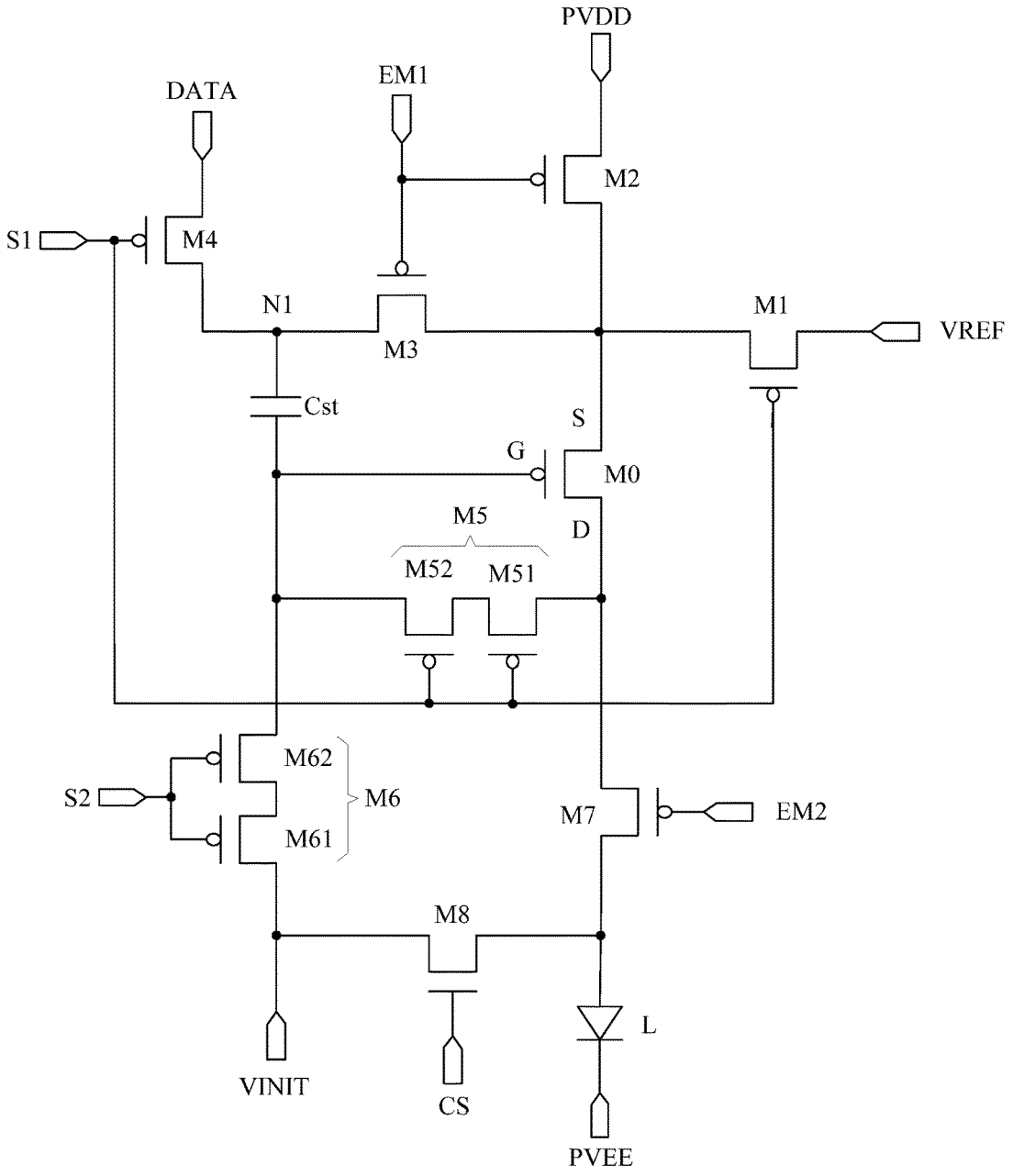
FIG. 2B illustrates another schematic diagram of a pixel compensation circuit consistent with various disclosed embodiments of the present disclosure.

Further, to eliminate the influence of a last glowing signal retained in the light-emitting device on the glow of the present frame, in one embodiment, in the pixel compensation circuit consistent with disclosed embodiments, referring to FIGS. 2A and 2B, on the basis of the pixel compensation circuit illustrated in FIG. 1, the pixel compensation circuit may include an eighth switch transistor M8. The eighth switch transistor M8 may provide the signal on the initialization signal terminal VINIT to the first terminal of the light-emitting device L under a control of a reset control signal terminal CS. Referring to FIGS. 2A and 2B, a gate of the eighth switch transistor M8 may be connected to the reset control signal terminal CS. A first electrode of the eighth switch transistor M8 may be connected to the initialization signal terminal VINIT. A second electrode of the eighth switch transistor M8 may be connected to the first terminal of the light-emitting device L. In one embodiment, referring to FIG. 2A, the eighth switch transistor M8 may be a P-type transistor. In another embodiment, referring to FIG. 2B, the eighth switch transistor may be an N-type transistor.

In one embodiment, in the pixel compensation circuit consistent with disclosed embodiment, the eighth switch transistor may provide the signal on the initialization signal terminal to the first terminal of the light-emitting device, that is an anode of the light-emitting device, under the control of the reset control signal terminal in at least one of the initialization phase and the threshold compensation phase, to reset the anode of the light-emitting device.

The pixel compensation circuits illustrated in FIGS. 2A and 2B in combination with the circuit timing sequence diagram are respectively used as an example in the following to describe the operation process of the pixel compensation circuit consistent with disclosed embodiments.

Figure 8A:
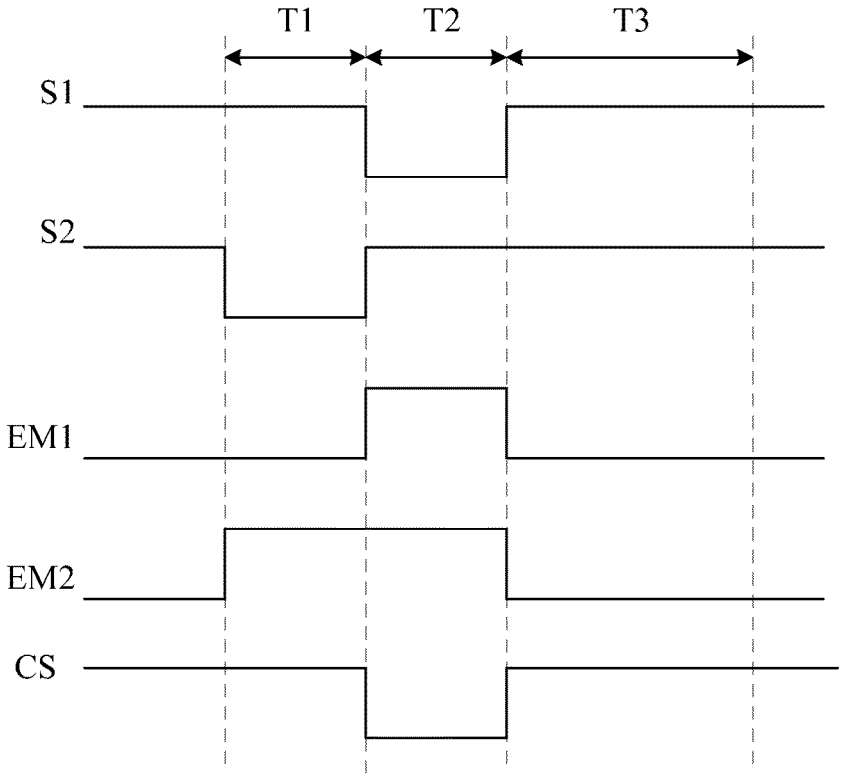
FIG. 8A illustrates another circuit timing sequence diagram consistent with various disclosed embodiments of the present disclosure.

FIG. 8A illustrates a circuit timing sequence diagram corresponding to the pixel compensation circuit illustrated in FIG. 2A. In one embodiment, an initialization phase T1, a threshold compensation phase T2 and a light-emitting phase T3 in the circuit timing sequence diagram illustrated in FIG.

8A are selected. Referring to FIG. 8A, the signal on the reset control signal terminal CS may be a low-potential signal in the threshold compensation phase T2, and may be a high-potential signal in both the initialization phase T1 and the light-emitting phase T3. Therefore, in one embodiment, the eighth switch transistor M8 may be turned on in the threshold compensation stage T2 to provide the signal on the initialization signal terminal VINIT to the first terminal of the light-emitting device L to reset the first terminal of the light-emitting device L. Therefore, the influence of the last glowing signal retained in the light-emitting device on the glow of the present frame may be avoided. The other operation processes of the pixel compensation circuit illustrated in FIG. 2A may be referred to the operation processes described in the above embodiment, and are not described in detail herein.

Figure 3:
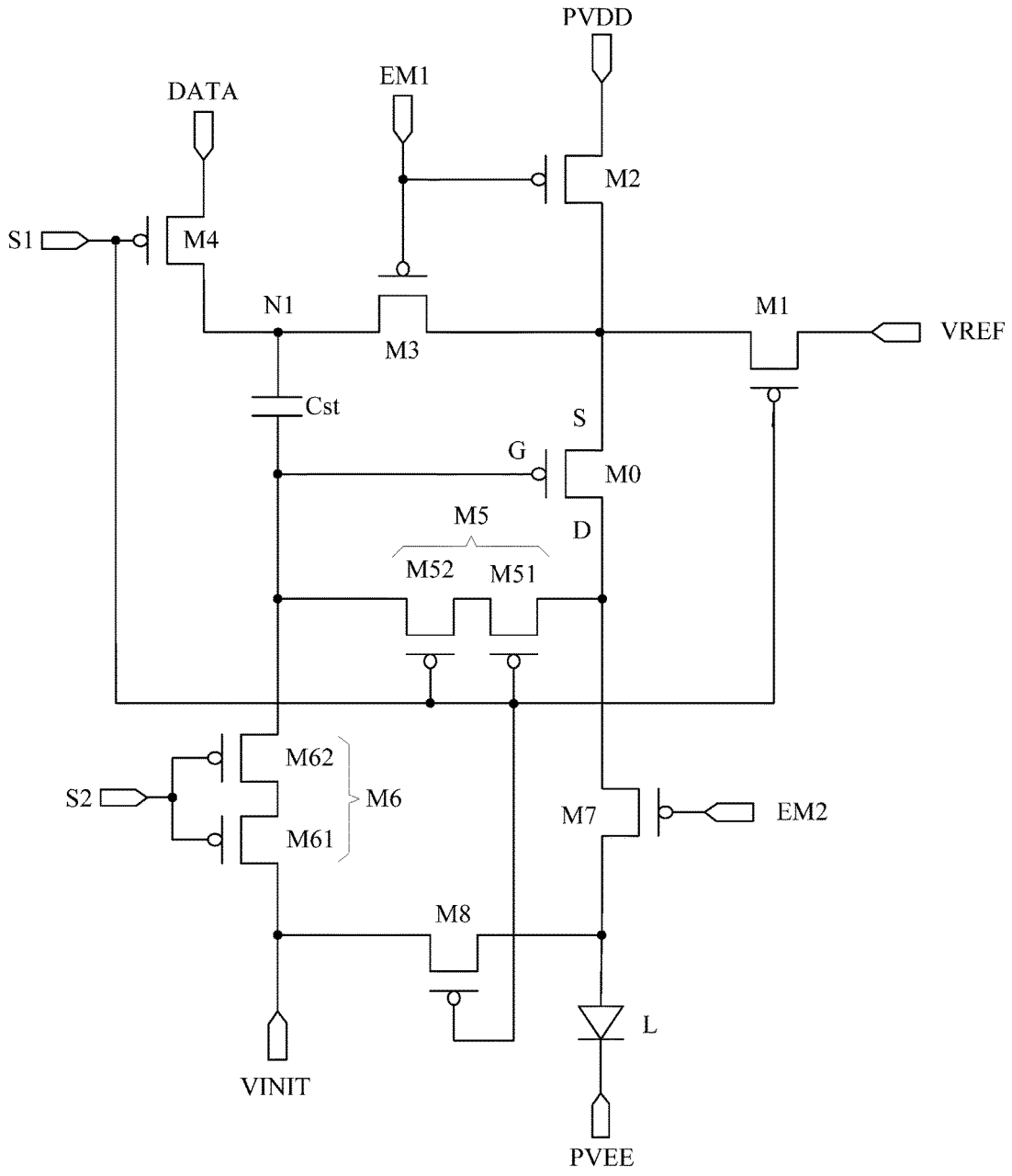
FIG. 3 illustrates another schematic diagram of a pixel compensation circuit consistent with various disclosed embodiments of the present disclosure.

Referring to FIG. 8A, the signal on the reset control signal terminal CS may be the same as the signal on the first scan signal terminal S1. Therefore, to reduce the signal line settings and to save the number of signal ports and the wiring space, in one embodiment, in the pixel compensation circuit consistent with disclosed embodiments, the reset control signal terminal and the first scan signal terminal may be the same signal terminal. The eighth switch transistor may be the same type as the first switch transistor. In one embodiment, referring to FIG. 3, on the basis of the pixel compensation circuit illustrated in FIG. 2A, the gate of the eighth switch transistor M8 may be connected to the first scan signal terminal S1. Both the eighth switch transistor M8 and the first switch transistor M1 may be P-type transistors. In another embodiment, both the eighth switch transistor and the first switch transistor may be N-type transistors. The other operation processes of the pixel compensation circuit illustrated in FIG. 3 may be referred to the operation processes described in the above embodiments, and are not described in detail herein.

Figure 8B:
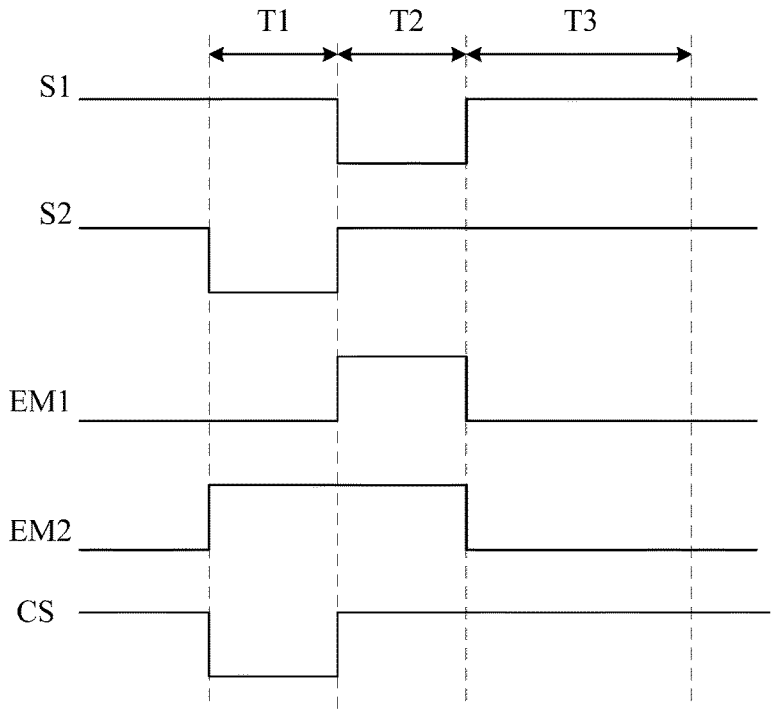
FIG. 8B illustrates another circuit timing sequence diagram consistent with various disclosed embodiments of the present disclosure.

FIG. 8B illustrates another circuit timing sequence diagram corresponding to the pixel compensation circuit illustrated in FIG. 2A. In one embodiment, an initialization phase T1, a threshold compensation phase T2 and a light-emitting phase T3 in the circuit timing sequence diagram illustrated in FIG. 8B are selected. Referring to FIG. 8B, the signal on the reset control signal terminal CS may be a low-potential signal in the initialization phase T1, and may be a high-potential signal in both the threshold compensation phase T2 and the light-emitting phase T3. Therefore, in one embodiment, the eighth switch transistor M8 may be turned on in the initialization phase T1 to provide the signal on the initialization signal terminal VINIT to the first terminal of the light-emitting device L to reset the first terminal of the light-emitting device L. Therefore, the influence of the last glowing signal retained in the light-emitting device on the glow of the present frame may be avoided. The other operation processes of the pixel compensation circuit illustrated in FIG. 2A may be referred to the operation processes described in the above embodiments, and are not described in detail herein.

Figure 4:
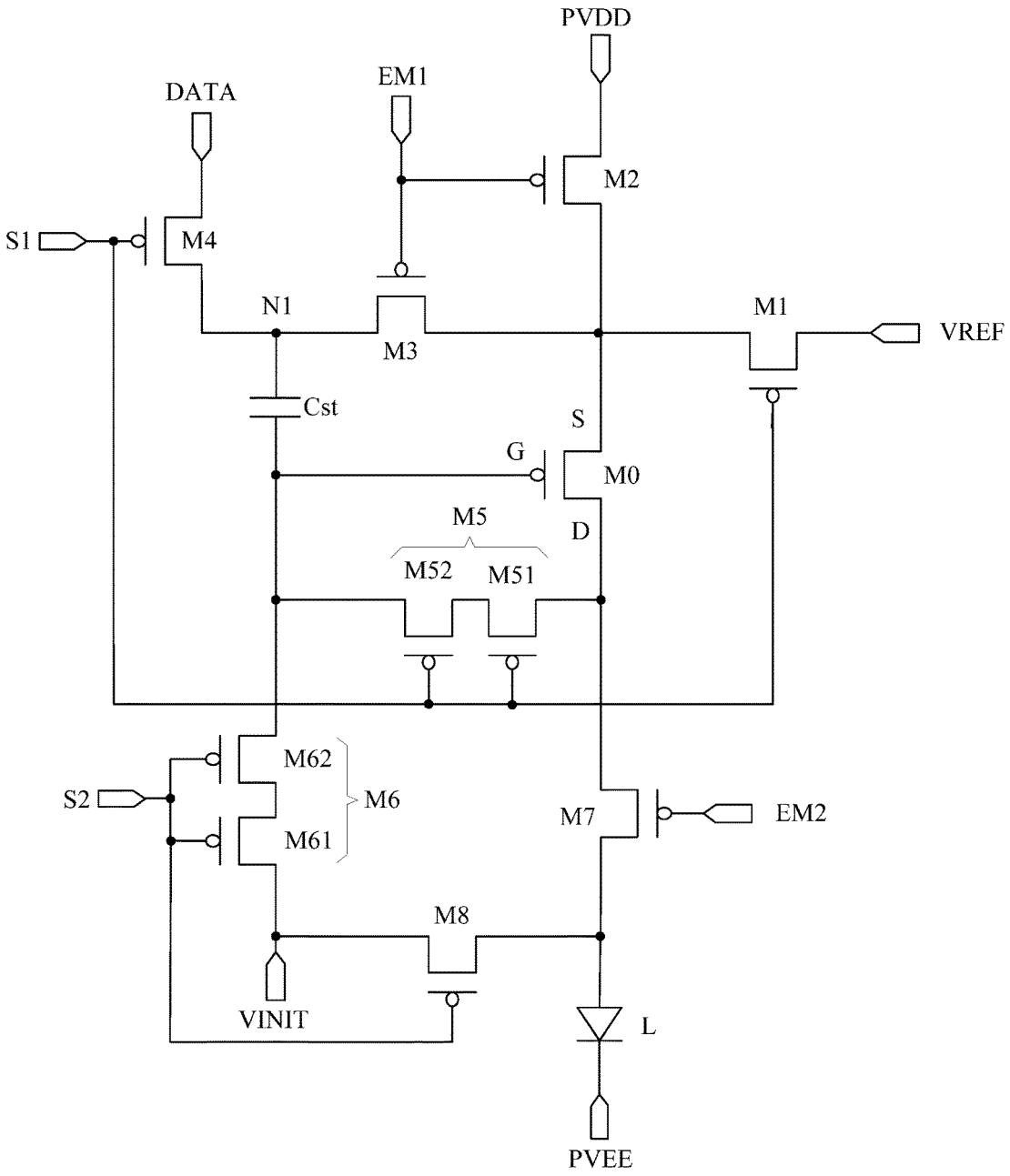
FIG. 4 illustrates another schematic diagram of a pixel compensation circuit consistent with various disclosed embodiments of the present disclosure.

Referring to FIG. 8B, the signal on the reset control signal terminal CS may be the same as the signal on the second scan signal terminal S2. Therefore, to reduce the signal line settings and to save the number of signal ports and the wiring space, in one embodiment, in the pixel compensation circuit consistent with disclosed embodiments, the reset control signal terminal and the second scan signal terminal may be the same signal terminal. The eighth switch transistor may be the same type as the sixth switch transistor. In one embodiment, referring to FIG. 4, on the basis of the pixel compensation circuit illustrated in FIG. 2A, the gate of the eighth switch transistor M8 may be connected to the second scan signal terminal S2. Both the eighth switch transistor M8 and the sixth switch transistor M6 may be P-type transistors. In another embodiment, both the eighth switch transistor and the sixth switch transistor may be N-type transistors. The other operation processes of the pixel compensation circuit illustrated in FIG. 4 may be referred to the operation processes of the pixel compensation circuit associated with FIG. 2A, and are not described in detail herein.

Figure 8C:
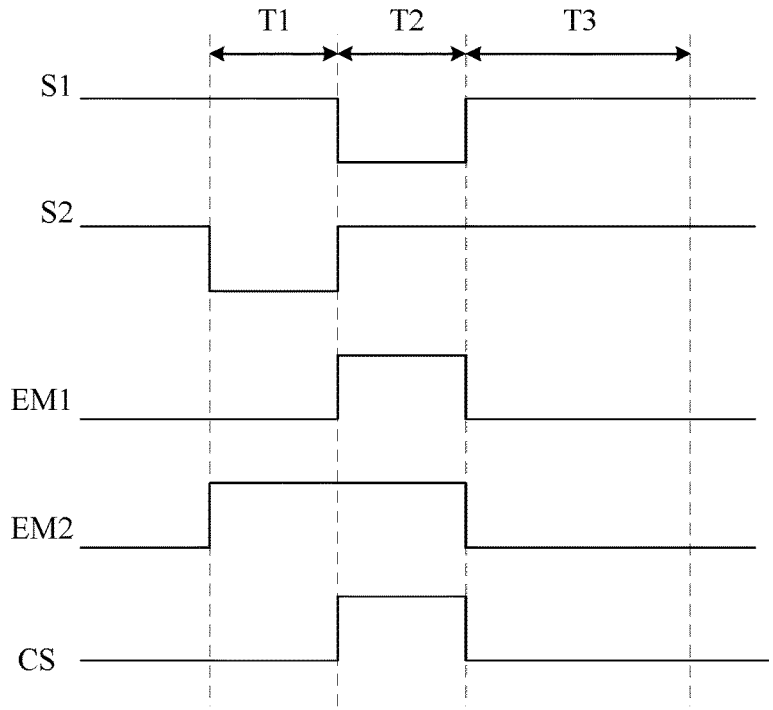
FIG. 8C illustrates another circuit timing sequence diagram consistent with various disclosed embodiments of the present disclosure.

FIG. 8C illustrates another circuit timing sequence diagram corresponding to the pixel compensation circuit illustrated in FIG. 2B. In one embodiment, an initialization phase T1, a threshold compensation phase T2, and a light-emitting phase T3 in the circuit timing sequence diagram illustrated in FIG. 8C are selected. Referring to FIG. 8C, the signal on the reset control signal terminal CS may be a high-potential signal in the threshold compensation phase T2, and may be a low-potential signal in both the initialization phase T1 and the light-emitting phase T3. Therefore, in one embodiment, the eighth switch transistor M8 may be turned on in the threshold compensation phase T2 to provide the signal on the initialization signal terminal VINIT to the first terminal of the light-emitting device L to reset the first terminal of the light-emitting device L. Therefore, the influence of the last glowing signal retained in the light-emitting device on the glow of the present frame may be avoided. The other operation processes of the pixel compensation circuit illustrated in FIG. 2B may be referred to the operation processes described in the above embodiments, and are not described in detail herein.

Figure 5:
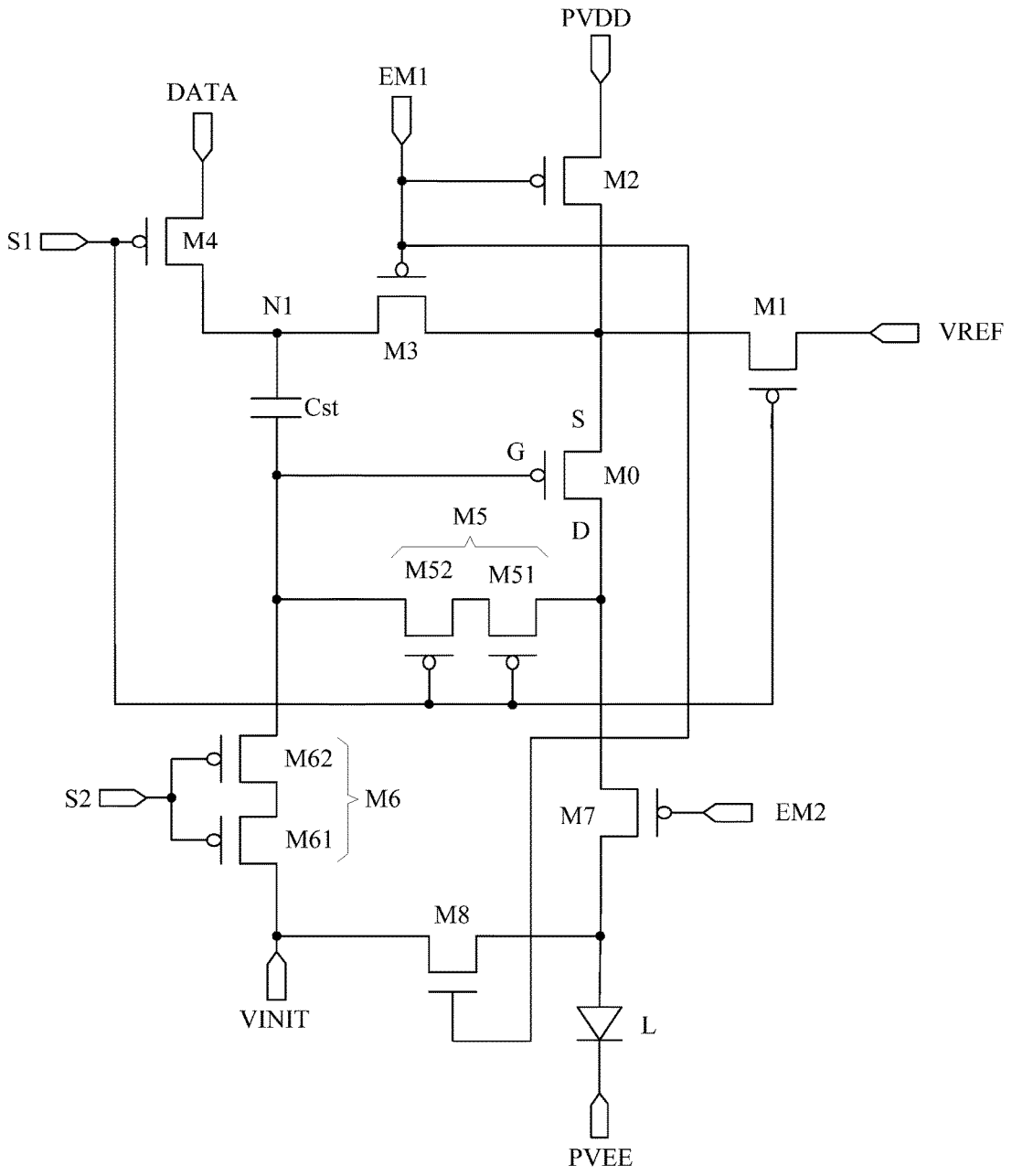
FIG. 5 illustrates another schematic diagram of a pixel compensation circuit consistent with various disclosed embodiments of the present disclosure.

Referring to FIG. 8C, the signal on the reset control signal terminal CS may be the same as the signal on the first light-emitting control signal terminal EM1. Therefore, to reduce the signal line settings and to save the number of signal ports and the wiring space, in one embodiment, in the pixel compensation circuit consistent with disclosed embodiments, the reset control signal terminal and the first light-emitting control signal terminal may be the same signal terminal. The type of the eighth switch transistor may be opposite to the type of the second switch transistor. In one embodiment, referring to FIG. 5, on the basis of the pixel compensation circuit illustrated in FIG. 2B, the gate of the eighth switch transistor M8 may be connected to the first light-emitting control signal terminal EM1. The eighth switch transistor M8 may be an N-type transistor, and the second switch transistor M2 may be a P-type transistor. In another embodiment, the eighth switch transistor may be a P-type transistor, and the second switch transistor may be an N-type transistor. The other operation processes of the pixel compensation circuit illustrated in FIG. 5 may be referred to the operation processes of the pixel compensation circuit associated with FIG. 2B, and are not described in detail herein.

Figure 8D:
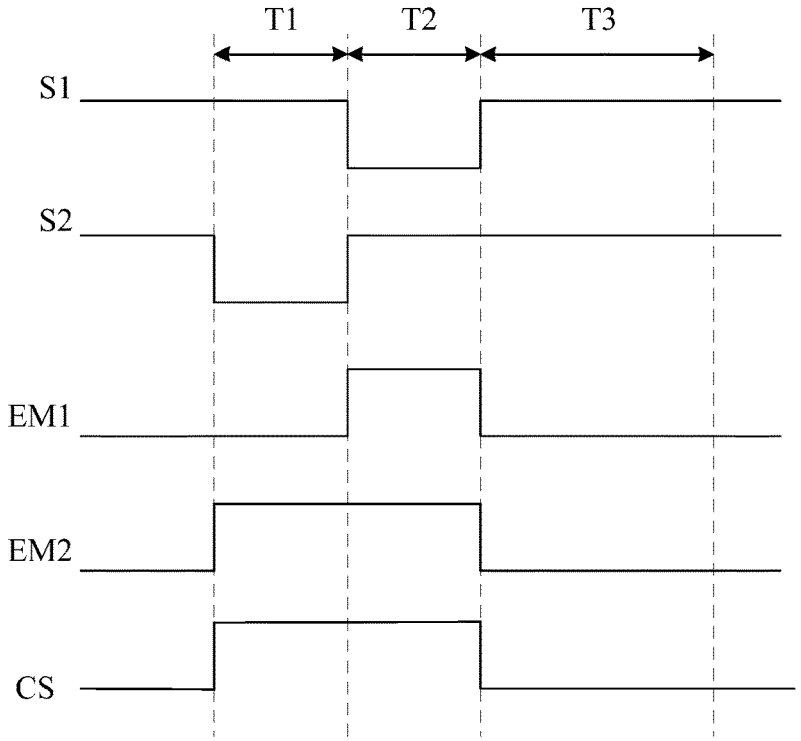
FIG. 8D illustrates another circuit timing sequence diagram consistent with various disclosed embodiments of the present disclosure.

FIG. 8D illustrates another circuit timing sequence diagram corresponding to the pixel compensation circuit illustrated in FIG. 2B. In one embodiment, an initialization phase T1, a threshold compensation phase T2, and a light-emitting phase T3 in the circuit timing sequence diagram illustrated in FIG. 8D are selected. Referring to FIG. 8D, the signal on the reset control signal terminal CS may be a high-potential signal in both the initialization phase T1 and the threshold compensation phase T2, and may be a low-potential signal in the light-emitting phase T3. Therefore, in one embodiment, the eighth switch transistor M8 may be turned on in the initialization phase T1 and the threshold compensation phase T2 to provide the signal on the initialization signal terminal VINIT to the first terminal of the light-emitting device L to reset the first terminal of the light-emitting device L. Therefore, the influence of the last glowing signal retained in the light-emitting device on the glow of the present frame may be avoided. The other operation processes of the pixel compensation circuit illustrated in FIG. 2B may be referred to the operation processes described in the above embodiments, and are not described in detail herein.

Figure 6:
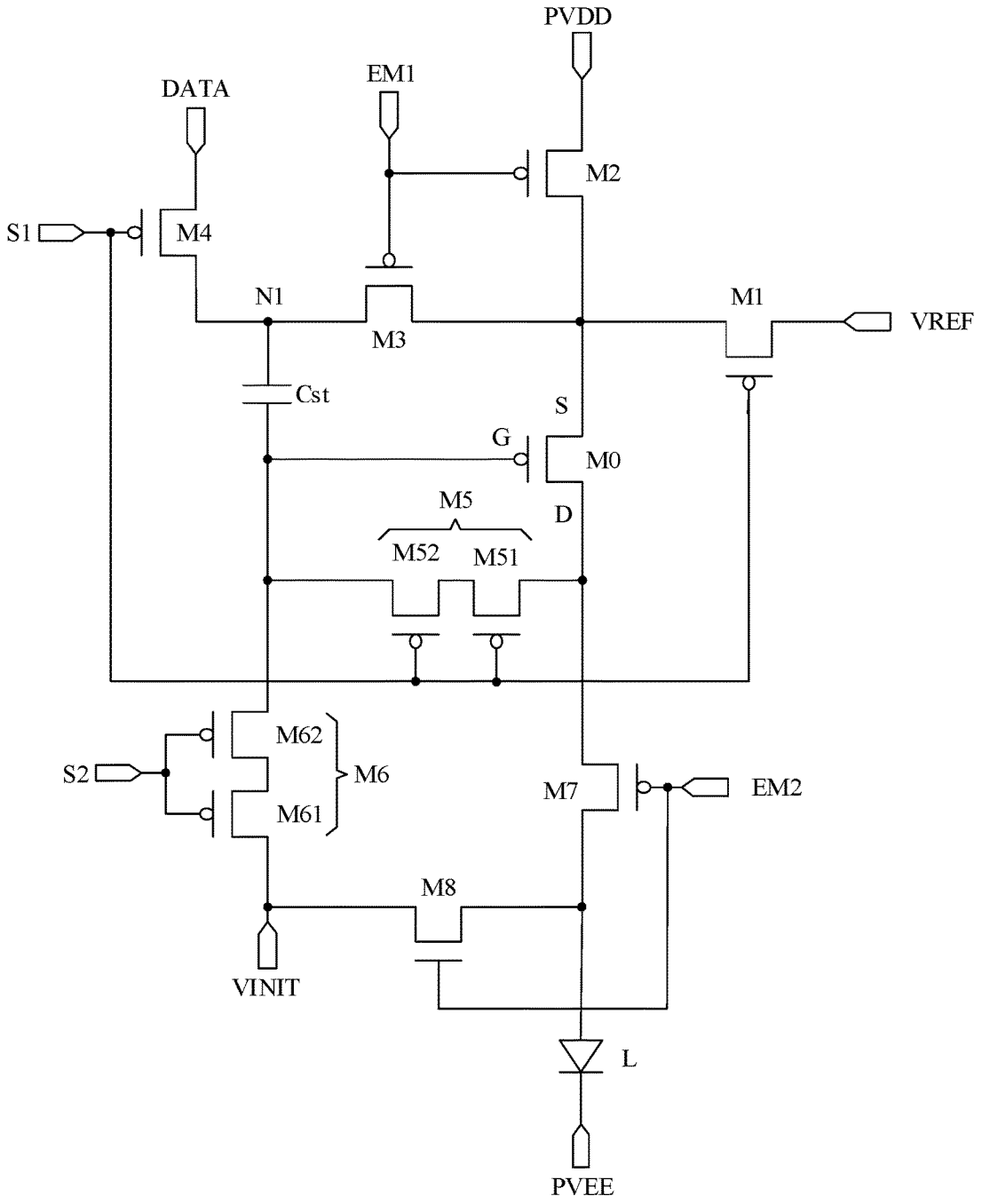
FIG. 6 illustrates another schematic diagram of a pixel compensation circuit consistent with various disclosed embodiments of the present disclosure.

Referring to FIG. 8D, the signal on the reset control signal terminal CS may be the same as the signal on the second light-emitting control signal terminal EM2. Therefore, to reduce the signal line settings and to save the number of signal ports and the wiring space, in one embodiment, in the pixel compensation circuit consistent with disclosed embodiments, the reset control signal terminal and the second light-emitting control signal terminal may be the same signal terminal. The type of the eighth switch transistor may be opposite to the type of the seventh switch transistor. In one embodiment, referring to FIG. 6, on the basis of the pixel compensation circuit illustrated in FIG. 2B, the gate of the eighth switch transistor M8 may be connected to the second light-emitting control signal terminal EM2. The eighth switch transistor M8 may be an N-type transistor, and the seventh switch transistor M7 may be a P-type transistor. In another embodiment, the eighth switch transistor may be a P-type transistor, and the seventh switch transistor may be an N-type transistor. The other operation processes of the pixel compensation circuit illustrated in FIG. 6 may be referred to the operation processes of the pixel compensation circuit associated with FIG. 2B, and are not described in detail herein.

The present disclosure also provides an organic light-emitting display panel. The organic light-emitting display panel may include any one of the pixel compensation circuits consistent with various embodiments of the present disclosure. The principle in which the organic light-emitting display panel solves the issues may be similar to that of the pixel compensation circuit. Therefore, the implementation of the organic light emitting display panel may be referred to the implementation of the pixel compensation circuit, and is not described in detail herein.

In one embodiment, in the organic light-emitting display panel consistent with disclosed embodiments, the organic light-emitting display panel may include a plurality of pixel units, a plurality of gate lines, a plurality of data lines, a plurality of first light-emitting control signal lines, a plurality of second light-emitting control signal lines, a first power supply line, an initialization signal line and a reference voltage signal line. Each gate line, each data line, each first light-emitting control signal line, each second light-emitting control signal line, the first power supply line, the initialization signal line and the reference voltage signal line may be insulated from each other. Each pixel unit may include a pixel driving circuit. A first scan signal terminal of the pixel driving circuit may be electrically connected to a gate line for applying a corresponding signal thereof, and a second scan signal terminal of the pixel driving circuit may be electrically connected to another gate line for applying a corresponding signal thereof.

The first light-emission control signal terminal may be electrically connected to the first light-emission control signal line for applying a corresponding signal thereof. The second light-emitting control signal terminal may be electrically connected to the second light-emitting control signal line for applying a corresponding signal thereof. The data signal terminal may be electrically connected to a data line for applying a corresponding data signal thereof. The reference voltage signal terminal may be electrically connected to the reference voltage signal line, the initialization signal terminal may be electrically connected to the initialization signal line, and the first power supply terminal may be electrically connected to the first power supply line.

In one embodiment, in the organic light-emitting display panel consistent with disclosed embodiments, the fabrication process of gate, a gate insulating layer, an active layer, a source and a drain of the switch transistor in the pixel driving circuit may be the same as that of the prior art, and is not described in detail herein.

In one embodiment, in the organic light-emitting display panel consistent with disclosed embodiments, each data line may be made of a same material and formed at a same layer as the first power supply line and the first electrode and the second electrode of the switch transistor in the pixel driving circuit. Each gate line, the reference voltage signal line, and the initialization signal line may be made of a same material and formed at a same layer as the gate of the switch transistor in the pixel driving circuit, respectively. Therefore, the patterns of the first electrode and the second electrode of the switch transistor in the pixel driving circuit, the plurality of data lines, the first power supply line may be simultaneously formed by one patterning process. The patterns of the plurality of gate lines, the reference voltage signal line, the initialization signal line and the gate of the switch transistor in the pixel compensation circuit may be formed by another one patterning process. Thus, the manufacturing process may be simplified and a thickness of the organic light-emitting display panel may be reduced.

In one embodiment, when each data line, the first power supply line and the first electrode and the second electrode of the switch transistor in the pixel driving circuit are made of a same material and formed at a same layer, in the organic light-emitting display panel consistent with disclosed embodiments, each data line may have a length direction parallel to a column direction of the plurality of pixel units. In one embodiment, in the organic light-emitting display panel consistent with disclosed embodiments, the first power supply line may be disposed in the organic light-emitting display panel in a grid-like structure.

In one embodiment, when each gate line, the reference voltage signal line, and the initialization signal line are made of a same material and formed at a same layer as the gate of the switch transistor in the pixel driving circuit, in the organic light-emitting display panel consistent with disclosed embodiments, each gate line, the reference voltage signal line, and the initialization signal line may have a length direction parallel to a row direction of the plurality of pixel units, respectively. Since the spacing between two adjacent rows of pixel units is generally larger than the spacing between two adjacent columns of pixel units, the organic light-emitting panel layout design may be further optimized by extending the reference voltage signal line and the initialization signal line along the row direction of the pixel units, respectively.

The present disclosure provides an organic light emitting display device. The organic display device may include an organic light emitting display panel consistent with disclosed embodiments. The principle that the organic light-emitting display device solves the issues may be similar to that of the organic light emitting display panel. Therefore, the implementation of the organic light emitting display device may be referred to the implementation of the organic light emitting display panel, and is not described in detail herein.

In one embodiment, the organic light emitting display device consistent with disclosed embodiments may include one or a combination of a double-sided display device, a flexible display device, and a full-screen display device.

Figure 9:
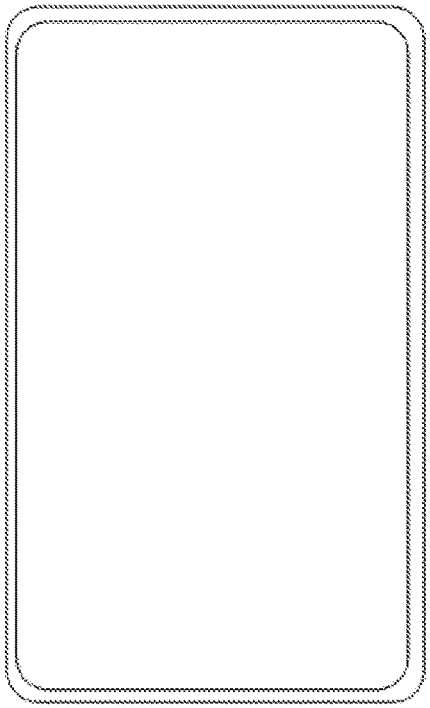
FIG. 9 illustrates a schematic diagram of an exemplary organic light-emitting display device consistent with various disclosed embodiments of the present disclosure.

In one embodiment, the full-screen display device may include a full-screen mobile phone illustrated in FIG. 9. In this case, the proportion of mobile phone screen may increase, and visual effects may be enhanced. In another embodiment, the full-screen display device may include other devices. In one embodiment, the flexible display device may include a bendable electronic device, such as an electronic paper. In one embodiment, the double-sided display device may include a device that enables the display on both sides of the display device.

In one embodiment, the display device in the present disclosure may include any products or components having a display function, such as a mobile phone, a tablet computer, a television, a display, a notebook computer, a digital photo frame, and a navigator, etc. Other indispensable components of the display device may be understood by those of ordinary skill in the art, and are not described in detail herein. Thus, the present invention is not intended to be limited to the embodiments shown herein.

The pixel compensation circuit, the organic light-emitting display panel and the organic light-emitting display device consistent with disclosed embodiments may include a first switch transistor, a second switch transistor, a third switch transistor, a fourth switch transistor, a fifth switch transistor and a sixth switch transistor, a seventh switch transistor, a drive transistor, a storage capacitor, and a light-emitting device. The signal on the data signal terminal may be inputted to the first node and the threshold voltage may be inputted to the gate of the drive transistor through the first switch transistor, the fourth switch transistor and the fifth switch transistor, thus the function for compensating the threshold voltage of the drive transistor may be realized. The signal on the first power supply terminal may be coupled in real time to the gate of the drive transistor in the light-emitting phase through the second switch transistor and the third switch transistor. Therefore, the driving current generated by the drive transistor may be protected from adverse effects caused by the IR Drop on the first power supply terminal, the unevenness in displaying brightness of the display panel may be improved and the screen display effect may be further improved.

The description of the disclosed embodiments is provided to illustrate the present invention to those skilled in the art. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A pixel compensation circuit, comprising:

a first switch transistor for providing a signal on a reference voltage signal terminal to a first electrode of a drive transistor under a control of a first scan signal terminal, wherein the first switch transistor includes a first electrode and a second electrode, and the second electrode is connected to the first electrode of the drive transistor;

a second switch transistor for providing a signal on a first power supply terminal to the first electrode of the drive transistor under a control of a first light-emitting control signal supplied by a first light-emitting control signal terminal;

a third switch transistor for conducting the first electrode of the drive transistor and a first node under the control of the first light-emitting control signal supplied by the first light-emitting control signal terminal, wherein the third switch transistor includes a first electrode connected to the first electrode of the drive transistor;

a fourth switch transistor for providing a signal on a data signal terminal to the first node under the control of the first scan signal terminal, wherein the fourth switch transistor includes a first electrode and a second electrode, and the second electrode is connected to the first node;

a fifth switch transistor for conducting a gate of the drive transistor and a second electrode of the drive transistor under the control of the first scan signal terminal;

a sixth switch transistor for providing a signal on an initialization signal terminal to the gate of the drive transistor under a control of a second scan signal terminal;

a light-emitting element having a first terminal and a second terminal, the second terminal being connected to a second power supply terminal;

a seventh switch transistor for providing a driving current generated by the drive transistor to the light-emitting element under a control of a second light-emitting control signal supplied by a second light-emitting control signal terminal to drive the light-emitting element to emit light, wherein the second light-emitting control signal is different from the first light-emitting control signal;

a storage capacitor for coupling a voltage on the first node to the gate of the drive transistor when floated; and the drive transistor for generating the driving current under a control of a voltage difference between the gate and the first electrode.

2. The pixel compensation circuit according to claim 1, further including:

an eighth switch transistor for providing the signal on the initialization signal terminal to the first terminal of the light-emitting element under a control of a reset control signal terminal.

3. The pixel compensation circuit according to claim 2, wherein:

the reset control signal terminal and the first scan signal terminal are a same signal terminal; or the reset control signal terminal and the second scan signal terminal are a same signal terminal; or the reset control signal terminal and the first light-emitting control signal terminal are a same signal terminal; or the reset control signal terminal and the second light-emitting control signal terminal are a same signal terminal.

4. The pixel compensation circuit according to claim 2, wherein:

a gate of the eighth switch transistor is connected to the reset control signal terminal;

a first electrode of the eighth switch transistor is connected to the initialization signal terminal; and a second electrode of the eighth switch transistor is connected to the first terminal of the light-emitting element.

5. The pixel compensation circuit according to claim 2, wherein:

the eighth switch transistor is a P-type transistor; or the eighth switch transistor is an N-type transistor.

6. The pixel compensation circuit according to claim 1, wherein:

a gate of the first switch transistor is connected to the first scan signal terminal, and the first electrode of the first switch transistor is connected to the reference voltage signal terminal;

a gate of the second switch transistor is connected to the first light-emitting control signal terminal, a first electrode of the second switch transistor is connected to the first power supply terminal, and a second electrode of the second switch transistor is connected to the first electrode of the drive transistor;

a gate of the third switch transistor is connected to the first light-emitting control signal terminal, and a second electrode of the third switch transistor is connected to the first node;

a gate of the fourth switch transistor is connected to the first scan signal terminal, and the first electrode of the fourth switch transistor is connected to the data signal terminal;

a gate of the fifth switch transistor is connected to the first scan signal terminal, a first electrode of the fifth switch transistor is connected to the second electrode of the drive transistor, and a second electrode of the fifth switch transistor is connected to the gate of the drive transistor;

a gate of the sixth switch transistor is connected to the second scan signal terminal, a first electrode of the sixth switch transistor is connected to the initialization signal terminal, and a second electrode of the sixth switch transistor is connected to the gate of the drive transistor;

a gate of the seventh switch transistor is connected to the second light-emitting control signal terminal, a first electrode of the seventh switch transistor is connected to the second electrode of the drive transistor, and a second electrode of the seventh switch transistor is connected to the first terminal of the light-emitting element; and a first terminal of the storage capacitor is connected to the first node, and a second terminal of the storage capacitor is connected to the gate of the drive transistor.

7. The pixel compensation circuit according to claim 1, wherein:

the first switch transistor, the second switch transistor, the third switch transistor, the fourth switch transistor, the fifth switch transistor, the sixth switch transistor, and the seventh switch transistor are P-type transistors.

8. The pixel compensation circuit according to claim 1, wherein:

types of the first switch transistor, the fourth switch transistor and the fifth switch transistor are the same.

9. The pixel compensation circuit according to claim 1, wherein:

types of the second switch transistor and the third switch transistor are the same.

10. The pixel compensation circuit according to claim 1, wherein:

the fifth switch transistor is a double gate structure.

11. The pixel compensation circuit according to claim 10, wherein:

a width of a channel region in an active layer of the fifth switch transistor is in a range of approximately 2.5 μm-3.5 μm; and a length of the channel region in the active layer of the fifth switch transistor is in a range of approximately 6 μm-8 μm.

12. The pixel compensation circuit according to claim 1, wherein:

the sixth switch transistor is a double gate structure.

13. The pixel compensation circuit according to claim 12, wherein:

a width of a channel region in an active layer of the sixth switch transistor is in a range of approximately 2.5 μm-3.5 μm; and a length of the channel region in the active layer of the sixth switch transistor is in a range of approximately 6 μm-8 μm.

14. The pixel compensation circuit according to claim 1, wherein:

any of the first switch transistor, the second switch transistor, the third switch transistor, the fourth switch transistor, the fifth switch transistor, the sixth switch transistor and the seventh switch transistor is a single gate transistor, a width of a channel region in an active layer of the single gate transistor is in a range of approximately 2.5 μm-3.5 μm; and a length of the channel region in the active layer of the single gate transistor is in a range of approximately 3 μm-4 μm.

15. The pixel compensation circuit according to claim 1, wherein:

a voltage difference between a voltage on the reference voltage signal terminal and a voltage on the initialization signal terminal is greater than a threshold voltage of the drive transistor.

16. An organic light-emitting display panel, comprising:

a pixel compensation circuit, including:

a first switch transistor for providing a signal on a reference voltage signal terminal to a first electrode of a drive transistor under a control of a first scan signal terminal, wherein the first switch transistor includes a first electrode and a second electrode, and the second electrode is connected to the first electrode of the drive transistor, a second switch transistor for providing a signal on a first power supply terminal to the first electrode of the drive transistor under a control of a first light-emitting control signal supplied by a first light-emitting control signal terminal, a third switch transistor for conducting the first electrode of the drive transistor and a first node under the control of the first light-emitting control signal supplied by the first light-emitting control signal terminal, wherein the third switch transistor includes a first electrode connected to the first electrode of the drive transistor, a fourth switch transistor for providing a signal on a data signal terminal to the first node under the control of the first scan signal terminal, wherein the fourth switch transistor includes a first electrode and a second electrode, and the second electrode is connected to the first node, a fifth switch transistor for conducting a gate of the drive transistor and a second electrode of the drive transistor under the control of the first scan signal terminal, a sixth switch transistor for providing a signal on an initialization signal terminal to the gate of the drive transistor under a control of a second scan signal terminal, a light-emitting element having a first terminal and a second terminal, the second terminal being connected to a second power supply terminal, a seventh switch transistor for providing a driving current generated by the drive transistor to the light-emitting element under a control of a second light-emitting control signal supplied by a second light-emitting control signal terminal to drive the light-emitting element to emit light, wherein the second light-emitting control signal is different from the first light-emitting control signal, a storage capacitor for coupling a voltage on the first node to the gate of the drive transistor when floated, and the drive transistor for generating the driving current under a control of a voltage difference between the gate and the first electrode.

17. The organic light-emitting display panel according to claim 16, further including:

a plurality of pixel units, a plurality of gate lines, a plurality of data lines, a plurality of first light-emitting control signal lines, a plurality of second light-emitting control signal lines, a first power supply line, an initialization signal line, and a reference voltage signal line, wherein:

each gate line, each data line, each first light-emitting control signal line, each second light-emitting control signal line, the first power supply line, the initialization signal line and the reference voltage signal line are insulated from each other, and each pixel unit includes a pixel driving circuit.

18. The organic light-emitting display panel according to claim 17, wherein:

each data line is made of a same material and formed at a same layer as the first power supply line and a first electrode and a second electrode of a switch transistor in the pixel driving circuit, and each gate line, the reference voltage signal line, and the initialization signal line are made of a same material and formed at a same layer as a gate of the switch transistor in the pixel driving circuit, respectively.

19. An organic light-emitting display device, comprising:

an organic light-emitting display panel, including a pixel compensation circuit, wherein the pixel compensation circuit includes:

a first switch transistor for providing a signal on a reference voltage signal terminal to a first electrode of a drive transistor under a control of a first scan signal terminal, wherein the first switch transistor includes a first electrode and a second electrode, and the second electrode is connected to the first electrode of the drive transistor, a second switch transistor for providing a signal on a first power supply terminal to the first electrode of the drive transistor under a control of a first light-emitting control signal supplied by a first light-emitting control signal terminal, a third switch transistor for conducting the first electrode of the drive transistor and a first node under the control of the first light-emitting control signal supplied by the first light-emitting control signal terminal, wherein the third switch transistor includes a first electrode connected to the first electrode of the drive transistor, a fourth switch transistor for providing a signal on a data signal terminal to the first node under the control of the first scan signal terminal, wherein the fourth switch transistor includes a first electrode and a second electrode, and the second electrode is connected to the first node, a fifth switch transistor for conducting a gate of the drive transistor and a second electrode of the drive transistor under the control of the first scan signal terminal, a sixth switch transistor for providing a signal on an initialization signal terminal to the gate of the drive transistor under a control of a second scan signal terminal, a light-emitting element having a first terminal and a second terminal, the second terminal being connected to a second power supply terminal, a seventh switch transistor for providing a driving current generated by the drive transistor to the light-emitting element under a control of a second light-emitting control signal supplied by a second light-emitting control signal terminal to drive the light-emitting element to emit light, wherein the second light-emitting control signal is different from the first light-emitting control signal, a storage capacitor, for coupling a voltage on the first node to the gate of the drive transistor when floated, and the drive transistor, for generating the driving current under a control of a voltage difference between the gate and the first electrode.

20. The organic light-emitting display device according to claim 19, wherein:

the organic light-emitting display device includes one or a combination of a double-sided display device, a flexible display device, and a full-screen display device.

* * * * *